US006273669B1

(12) United States Patent
Tanaka

(10) Patent No.: US 6,273,669 B1
(45) Date of Patent: Aug. 14, 2001

(54) SINGLE LEVER WITH BUTTON FOR SELECTIVELY CONTROLLING EITHER TILT OR LIFT OF A FORKLIFT MECHANISM

(75) Inventor: Shinobu Tanaka, Shiga (JP)

(73) Assignee: Nippon Yusoki Co., Ltd., Kyoto (JP)

( * ) Notice: Subject to any disclaimer, the term of this patent is extended or adjusted under 35 U.S.C. 154(b) by 0 days.

(21) Appl. No.: 09/411,256

(22) Filed: Oct. 4, 1999

(30) Foreign Application Priority Data

Oct. 2, 1998 (JP) ..... 10-280623

(51) Int. Cl.[7] ..... B66F 9/24

(52) U.S. Cl. ..... 414/634; 414/620; 414/642; 187/223; 187/224

(58) Field of Search ..... 414/618, 619, 414/620, 628, 629, 630, 631, 632, 633, 634, 635, 636, 641, 642; 187/222, 223, 224, 234

(56) References Cited

U.S. PATENT DOCUMENTS 4,097,791 * 6/1978 Bivens et al. ..... 318/484
4,757,712 * 7/1988 Jurca ..... 73/865.9
5,238,086 * 8/1993 Aoki et al. ..... 187/223

FOREIGN PATENT DOCUMENTS 63-293230 * 11/1988 (JP) ..... 414/634
3-240113 * 10/1991 (JP) ..... 414/634
4-365798 * 12/1992 (JP) ..... 414/634
8-268696 * 10/1996 (JP) ..... 414/634
8-282994 * 10/1996 (JP) ..... 414/634
11-092099 * 4/1999 (JP) ..... 414/634

* cited by examiner

*Primary Examiner*—Robert P. Olszewski
*Assistant Examiner*—Gerald J. O'Connor
(74) *Attorney, Agent, or Firm*—Sughrue, Mion, Zinn, Macpeak & Seas, PLLC

(57) ABSTRACT

In a load handling apparatus for a counterbalance type forklift, action and speed conditions of tilting a mast and lifting and lowering a fork are operated by use of a single operating lever and a single switch attached to the operating lever. Also, a controller is provided that prevents simultaneous operation of action conditions. The controller includes an inhibiting circuit that halts all action conditions when the operational state of the switch is changed during operation, and thus, unintended action conditions due to erroneous operation of the switch are prevented.

7 Claims, 4 Drawing Sheets

SINGLE LEVER WITH BUTTON FOR SELECTIVELY CONTROLLING EITHER TILT OR LIFT OF A FORKLIFT MECHANISM

BACKGROUND OF THE INVENTION

1. Field of the Invention

The present invention relates to a load handling apparatus for a counterbalance type forklift in which actions of lifting and lowering a fork, and tilting a mast are conducted by means of a single operating lever for handling a load. The load handling apparatus is configured so as to prevent the action condition from being suddenly changed by an erroneous operation, thereby improving safety.

2. Description of the Related Art

In a conventional counterbalance type forklift in which actions of lifting and lowering a fork, and tilting a mast are conducted by means of a single operating lever for handling a load. In such a counterbalance type forklift, a push button switch is disposed on the load operating lever, and an operation of only the load operating lever and that of both the load operating lever and the push button switch are selectively employed. When, during a period when both the load operating lever and the push button switch are operated, the push button switch is released by any reason, therefore, the action condition intended by the driver is suddenly changed to that not intended by the driver, thereby producing a problem in that the driver may receive any injury.

SUMMARY OF THE INVENTION

An object of the present invention is to provide a load handling apparatus for a counterbalance type forklift which prevents the above defects with the conventional apparatus.

To achieve the above object, according to the present invention, there is provided a load handling apparatus for a counterbalance type forklift in which a tiltable operating lever is disposed on a body of the forklift, a mast which is tiltable in an anteroposterior direction is disposed on the forklift, a liftable fork is disposed on the mast, and a tilting speed of the mast and lifting and lowering speeds of the fork are controlled by a degree of opening of a solenoid proportional control valve, the degree of opening being proportional to a tilting angle of the operating lever, wherein a number of the operating lever disposed on the body is one, a switch is attached to the operating lever, and the apparatus comprises a controller which performs controls in the following manner: when the operating lever is tilted under a state where the switch is operated, a signal for tilting the mast is output; when only the operating lever is operated, a signal for lifting or lowering the fork is output; and, when the switch is changed to a inactive condition under a state where the operating lever is in an tilting operation condition, actions of lifting and lowering the fork are disabled unless the operating lever is returned to a neutral condition.

DETAILED DESCRIPTION OF THE PREFERRED EMBODIMENTS

An embodiment of the invention will be described with reference to the accompanying drawings.

Figure 1:
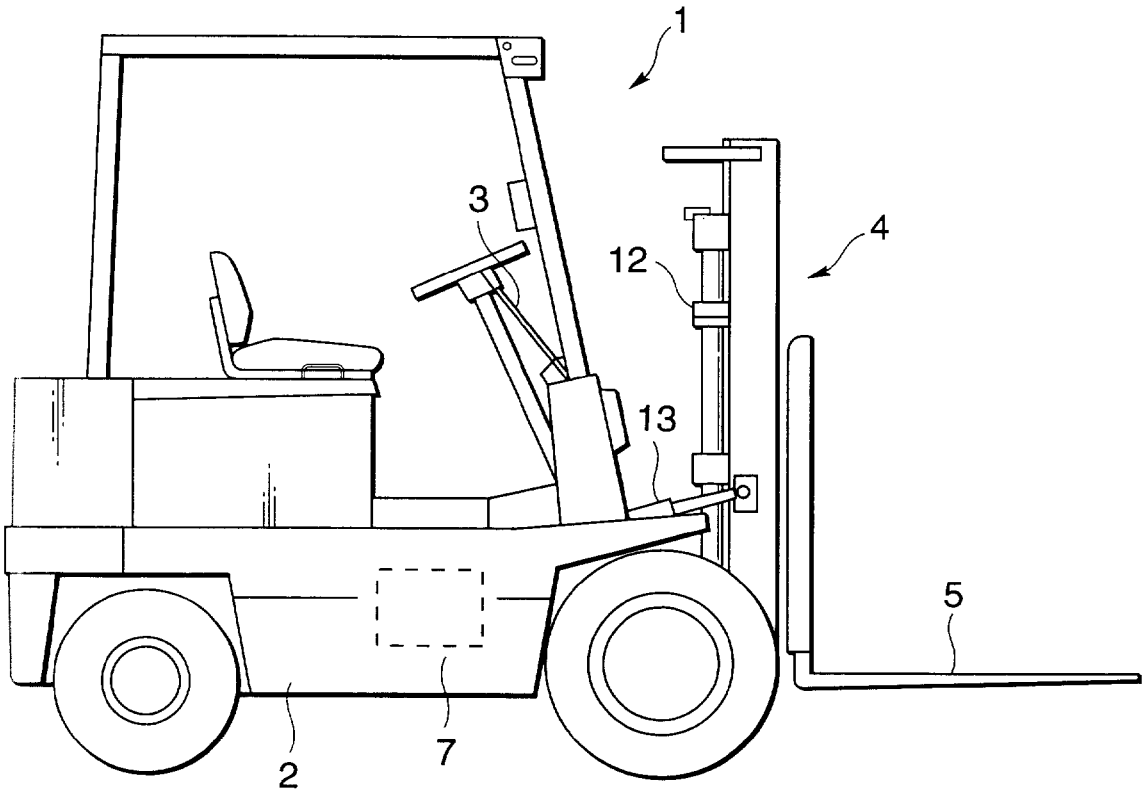
FIG. 1 is a side view of a counterbalance type forklift in the invention.
Figure 2:
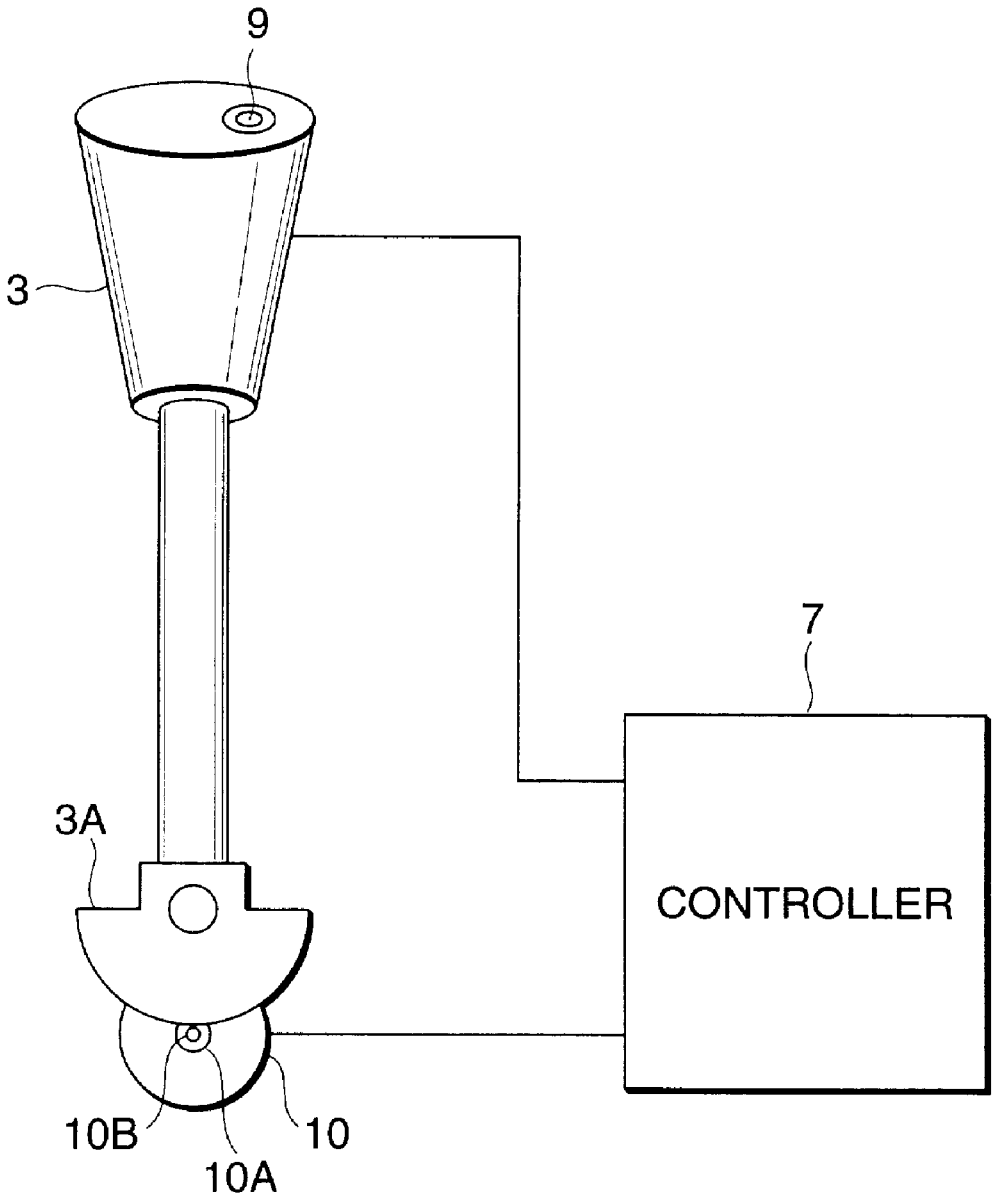
FIG. 2 is a side view of an operating lever in the invention.

FIG. 1 is a side view of a counterbalance type forklift (hereinafter, referred to as merely "forklift"). The forklift 1 includes the body 2, a mast 4 which is tiltably disposed in front of the body 2, and a fork 5 which is liftably disposed on the mast 4. A single operating lever 3 is tiltably disposed on the body 2. A switch 9 is disposed on a tip end of a gripping portion of the operating lever 3. As shown in FIG. 2, a first sector gear 3A is fixed to an end of the operating lever 3. A second gear 10A which is fixed to a rotation shaft 10B of a rotational amount detector 10 (such as a potentiometer or an encoder) meshes with the first gear 3A. The lifting and lowering speeds of the fork 5, and the tilting speed of the mast 4 are controlled by the degree of opening of a solenoid proportional control valve which is proportional to the tilting angle of the operating lever 3.

When the operating lever 3 is singly operated, an output of the potentiometer 10 which is proportional to the tilting angle of the operating lever 3 is supplied to a controller 7. The degree of opening of a first solenoid proportional control valve 61 is controlled by an output control signal supplied from the controller 7, thereby controlling the lifting and lowering speeds of the fork 5. In contrast, when the operating lever 3 is operated while the switch 9 is kept to be operated, the output of the potentiometer 10 which is proportional to the tilting angle of the operating lever 3 is supplied to the controller 7. The degree of opening of a second solenoid proportional control valve 62 is controlled by an output control signal supplied from the controller 7, thereby controlling the tilting speed of the mast 4.

The controller 7 receives an output of the rotational amount detector 10, and an electric signal of the push button switch 9, and converts them into electric signals of a desired frequency. The converted electric signals are supplied to a solenoid proportional control valve driving circuit 11 connected to the first and second solenoid proportional control valves 61 and 62, to obtain degrees of opening which are proportional to the tilting angle of the operating lever 3. As a result, actions of lifting or lowering the fork 5, and tilting the mast 4 are conducted at respective predetermined speeds.

Figure 3:
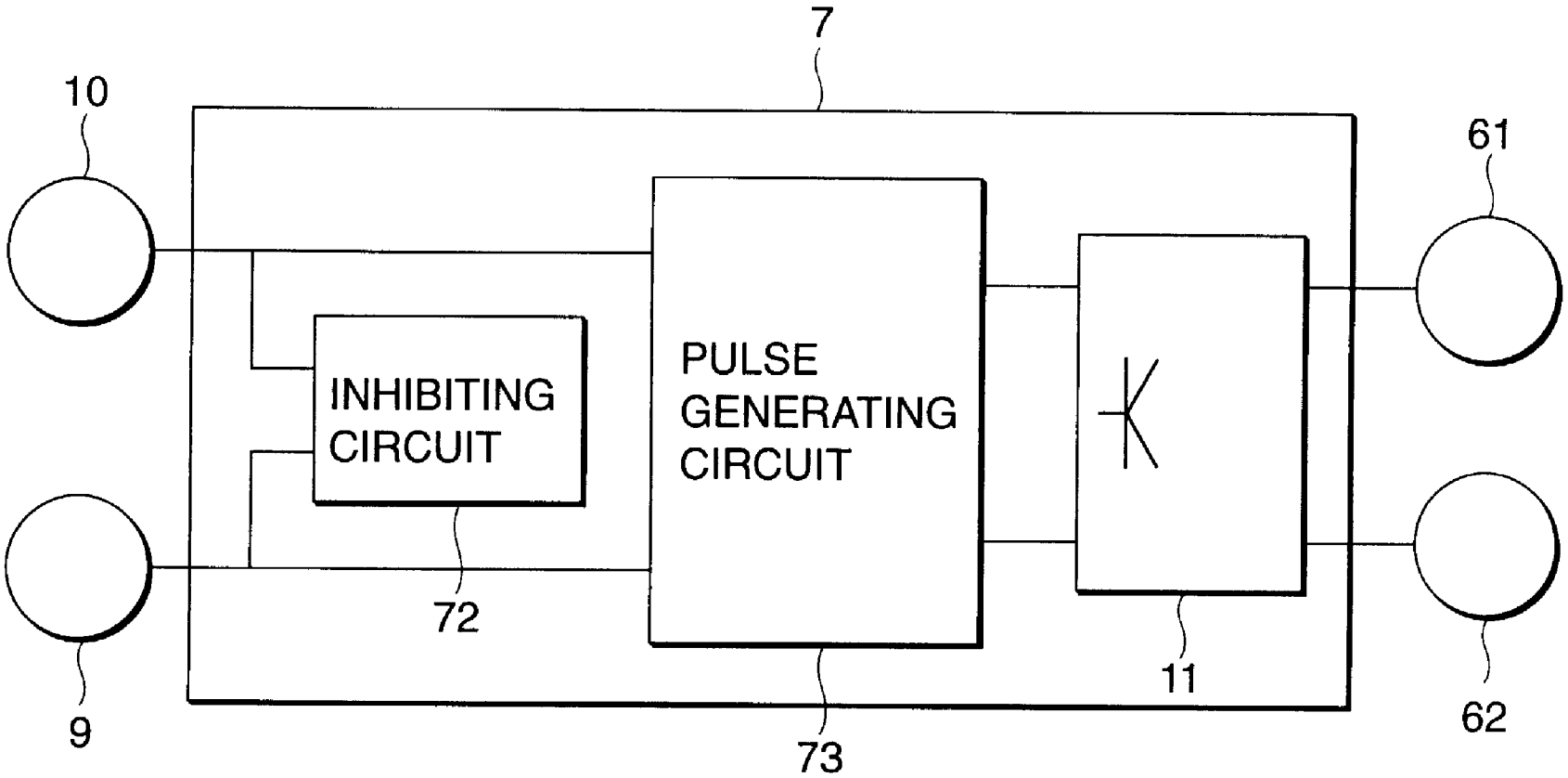
FIG. 3 is a block diagram of a controller in the invention.

The controller 7 is configured in the following manner. When the operating lever 3 is operated while the switch 9 is kept to be operated, the action of tilting the mast 4 is obtained. When the switch 9 is released during this operation, an inhibiting circuit 72 shown in FIG. 3 is activated so as to block the pulse generation in a pulse generating circuit 73, thereby stopping the tilting action of the mast 4 and the lifting or lowering action. When the operating lever 3 is once returned to a neutral position, the inhibiting condition of the inhibiting circuit 72 which has been activated is cancelled, so as to attain a state where pulses generated by the pulse generating circuit 73 are enabled to be applied to the solenoid proportional control valve driving circuit 11.

Figure 4:
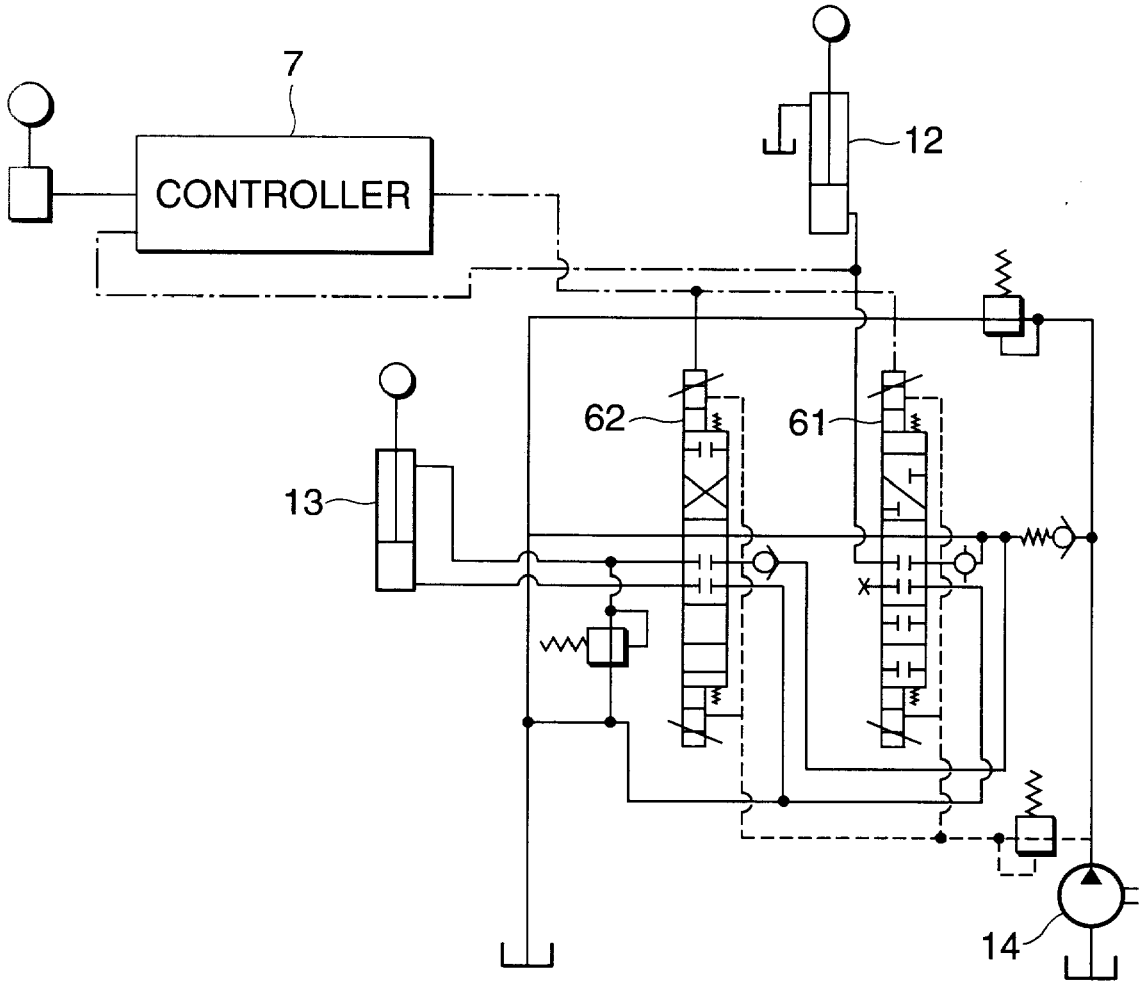
FIG. 4 is a diagram of a hydraulic circuit in the invention.

In a hydraulic circuit shown in FIG. 4, used are two solenoid proportional control valves, i.e., the first solenoid proportional control valve 61 which is used for lifting or lowering the fork 5, and the second solenoid proportional control valve 62 for tilting the mast in an anteroposterior direction. The first solenoid proportional control valve 61 is connected to a pipe between a fork action cylinder 12 and a hydraulic pump 14. The second solenoid proportional control valve 62 is connected between a mast tilting cylinder 13 and the hydraulic pump 14. Pressure oil from the hydraulic pump 14 is supplied to the fork action cylinder 12 or the mast tilting cylinder 13, via one of the first and second solenoid proportional control valves 61 and 62 which one is selected by the above-mentioned switching function.

Therefore, the fork is lifted or lowered by the fork action cylinder 12 so that the lifting and lowering actions are conducted at a speed which is proportional to the tilting angle of the operating lever 3, or the mast 4 is tilted forward or rearward by the mast tilting cylinder 13. Also the tilting action in an anteroposterior direction is conducted at a speed which is proportional to the tilting angle of the operating lever 3.

As described above, according to the invention, because of the above-described configuration, the action of lifting or lowering the fork, and that of tilting the mast can be conducted by the single operating lever without paying attention to the operation direction, and hence the operability is improved. In the case of an erroneous operation of the switch, the tilting action of the mast and the lifting and lowering actions of the fork are disabled. Furthermore, the operation for the lifting action and that for the tilting action cannot be simultaneously conducted. Therefore, the safety can be further improved.

What is claimed is:

1. A load handling apparatus for a counterbalance type forklift, comprising:

a tiltable operating lever disposed on a body of said forklift;

a mast tiltable in a first direction and disposed on said forklift;

a liftable fork disposed on said mast;

a switch attached to said operating lever;

a control valve, in which a tilting of said mast and a lifting and a lowering of said fork are controlled by a degree of opening of said control valve, said degree of opening being proportional to a tilting angle of said operating lever; and a controller that outputs a signal for tilting said mast when said operating lever is tilted while a switching state of said switch is in a first switching state, outputs a signal for lifting or lowering said fork when said operating lever is tilted while the switching state of said switch is in a second switching state, and disables actions of tilting said mast and lifting and lowering said fork when said operating lever is tilted while the switching state of said switch is changed, unless said operating lever is returned to a neutral position.

2. A load handling apparatus as claimed in claim 1, wherein said control valve is a solenoid proportional control valve.

3. A load handling apparatus as claimed in claim 1, wherein said controller prohibits simultaneous operation of the tilting of said mast and the lifting and lowering of said fork.

4. A load handling apparatus for a counterbalance type forklift, comprising:

a tiltable operating lever disposed on a body of said forklift;

a mast tiltable in a first direction and disposed on said forklift;

a liftable fork disposed on said mast;

a switch attached to said operating lever;

a control valve, in which a tilting of said mast and a lifting and a lowering of said fork are controlled by a degree of opening of said control valve, said degree of opening being proportional to a tilting angle of said operating lever; and a controller that outputs a signal for tilting said mast when said operating lever is tilted while a switching state of said switch is in a first switching state, outputs a signal for lifting or lowering said fork when said operating lever is tilted while the switching state of said switch is in a second switching state, and disables actions of tilting said mast and lifting and lowering said fork when said operating lever is tilted while the switching state of said switch is changed, unless said operating lever is returned to a neutral position, wherein said controller includes an inhibiting circuit for stopping the tilting action of said mast and the lifting and lowering action of said fork when said operating lever is tilted while the switching state of said switch is changed.

5. A load handling apparatus for use with a forklift, comprising:

a mast;

a fork that is slidably coupled to said mast;

a tiltable operating lever;

a switch coupled to said operating lever;

at least one control valve that controls a tilting of said mast and a sliding of said fork with respect to said mast;

a controller that outputs at least one signal to said at least one control valve to control said tilting of said mast and said sliding of said fork, wherein said controller outputs said at least one signal based on a switching state of said switch and a tilting state of said operating lever, wherein said controller outputs said at least one signal to said at least one control valve to control said tilting of said mast while said switching state of said switch is in a first switching state and based on the tilting state of said operating lever; and an inhibiting circuit wherein said inhibiting circuit stops said tilting of said mast when said operating lever is tilted and said switching state of said switch is changed from said first switching state.

6. A load handling apparatus for use with a forklift, comprising:

a mast;

a fork that is slidably coupled to said mast;

a tiltable operating lever;

a switch coupled to said operating lever;

at least one control valve that controls a tilting of said mast and a sliding of said fork with respect to said mast;

a controller that outputs at least one signal to said at least one control valve to control said tilting of said mast and said sliding of said fork, wherein said controller outputs said at least one signal based on a switching state of said switch and a tilting state of said operating lever, wherein said controller outputs said at least one signal to said at least one control valve to control said tilting of said mast while said switching state of said switch is in a first switching state and based on the tilting state of said operating lever, wherein said controller outputs said at least one signal to said at least one control valve to control said sliding of said fork while said switching state of said switch is in a second switching state and based on the tilting state of said operating lever; and an inhibiting circuit wherein said inhibiting circuit stops said sliding of said fork when said operating lever is tilted and said switching state of said switch is changed from said second switching state.

7. A load handling apparatus for use with a forklift, comprising:

a mast;

a fork that is slidably coupled to said mast;

a tiltable operating lever;

a switch coupled to said operating lever;

at least one control valve that controls a tilting of said mast and a sliding of said fork with respect to said mast; and a controller that outputs at least one signal to said at least one control valve to control said tilting of said mast and said sliding of said fork, wherein said controller outputs said at least one signal based on a switching state of said switch and a tilting state of said operating lever, wherein said controller outputs said at least one signal to said at least one control valve to control said sliding of said fork while said switching state of said switch is in a first switching state and based on the tilting state of said operating lever; and an inhibiting circuit wherein said inhibiting circuit stops said sliding of said fork when said operating lever is tilted and said switching state of said switch is changed from said first switching state.

* * * * *